US007486266B2

(12) United States Patent
Kim

(10) Patent No.: US 7,486,266 B2
(45) Date of Patent: Feb. 3, 2009

(54) LIQUID CRYSTAL DISPLAY DEVICE, AND METHOD FOR DRIVING THE SAME

(75) Inventor: Gi Hong Kim, Gyeonggi-Do (KR)

(73) Assignee: LG Display Co., Ltd., Seoul (KR)

( * ) Notice: Subject to any disclaimer, the term of this patent is extended or adjusted under 35 U.S.C. 154(b) by 763 days.

(21) Appl. No.: 11/017,016

(22) Filed: Dec. 21, 2004

(65) Prior Publication Data

US 2005/0134543 A1 Jun. 23, 2005

(30) Foreign Application Priority Data

Dec. 23, 2003 (KR) ..... 10-2003-0095744

(51) Int. Cl.
*G09G 3/36* (2006.01)

(52) U.S. Cl. ..... 345/98; 345/102

(58) Field of Classification Search ..... 345/87, 345/98, 102, 690, 204
See application file for complete search history.

(56) References Cited

U.S. PATENT DOCUMENTS 5,689,280 A * 11/1997 Asari et al. ..... 345/89
5,929,832 A * 7/1999 Furukawa et al. ..... 345/98
5,982,347 A * 11/1999 Shigeta et al. ..... 345/88
6,271,821 B1 * 8/2001 Sung et al. ..... 345/98
2002/0044115 A1 * 4/2002 Jinda et al. ..... 345/87
2002/0186192 A1 * 12/2002 Maruoka et al. ..... 345/87
2005/0052386 A1 * 3/2005 Kwon et al. ..... 345/87

* cited by examiner

*Primary Examiner*—Amr Awad
*Assistant Examiner*—Stephen G Sherman
(74) *Attorney, Agent, or Firm*—McKenna Long & Aldridge LLP

(57) ABSTRACT

The present invention discloses an LCD device and a method for driving the same that record one frame of an image on first blocks of a memory unit consisting of a plurality of first blocks and one or more second blocks with a first frequency, record a succeeding frame of the image on one or more second blocks and some of the first blocks with the first frequency, and read the frames of the image sequentially recorded on the first blocks and one or more second blocks with a second frequency in a multiple number, so that the LCD device can be time-sequentially driven. As a result, the required recording capacity of the memory unit for driving the time-sequential LCD device at a high speed may be minimized.

20 Claims, 5 Drawing Sheets

| FRAME | RECORDING | READING |
|---|---|---|
| FIRST FRAME | BL 1<br>BL 2<br>BL 3 | <br><br>BL 1~BL 3 |
| SECOND FRAME | BL 4<br>BL 1<br>BL 2 | BL 1~BL 3<br>BL 1~BL 3<br>BL 4~BL 2 |
| THIRD FRAME | BL 3<br>BL 4<br>BL 1 | BL 4~BL 2<br>BL 4~BL 2<br>BL 3~BL 1 |
| ⋮ | ⋮ | ⋮ |

| FRAME | RECORDING | READING |
|---|---|---|
| FIRST FRAME | BL 1<br>BL 2<br>BL 3 | <br><br>BL 1~BL 3 |
| SECOND FRAME | BL 4<br>BL 1<br>BL 2 | BL 1~BL 3<br>BL 1~BL 3<br>BL 4~BL 2 |
| THIRD FRAME | BL 3<br>BL 4<br>BL 1 | BL 4~BL 2<br>BL 4~BL 2<br>BL 3~BL 1 |
| ⋮ | ⋮ | ⋮ |

FIG. 6

| FRAME | RECORDING | READING |
|---|---|---|
| FIRST FRAME | BL 1 | |
| | BL 2 | |
| | BL 3 | |
| | BL 4 | |
| | BL 5 | |
| | BL 6 | |
| | BL 7 | |
| | BL 8 | |
| | BL 9 | |
| SECOND FRAME | BL 10 | BL 1~BL 9 |
| | BL 11 | X |
| | BL 12 | X |
| | BL 13 | BL 1~BL 9 |
| | BL 14 | X |
| | BL 15 | X |
| | BL 1 | BL 1~BL 9 |
| | BL 2 | X |
| | BL 3 | X |
| THIRD FRAME | BL 4 | BL 10~BL 3 |
| | BL 5 | X |
| | BL 6 | X |
| | BL 7 | BL 10~BL 3 |
| | BL 8 | X |
| | BL 9 | X |
| | BL 10 | BL 10~BL 3 |
| | BL 11 | X |
| | BL 12 | X |
| ⋮ | ⋮ | ⋮ |

LIQUID CRYSTAL DISPLAY DEVICE, AND METHOD FOR DRIVING THE SAME

This application claims the benefit of Korean Patent Application No. 2003-95744, filed on Dec. 23, 2003, which is hereby incorporated by reference for all purposes as if fully set forth herein.

BACKGROUND OF THE INVENTION

1. Field of the Invention

The present invention relates to an LCD device and a method for driving the same, and more particularly to, an LCD device and a method for driving the same which can minimize a recording capacity of a frame memory for recording and reading a frame of image data so that the time-sequential LCD device can be driven at a high speed.

2. Description of the Related Art

In general, cathode ray tubes (CRTs) are among the most widely-used display devices, used for measuring instruments and information terminals as well as televisions. However, CRTs are not suited for the small size and light weight requirements of electronic products due to its size and weight.

Therefore, liquid crystal display (LCD) devices having the advantages of small size, light weight and low power consumption, have been developed to replace CRTs.

Driving the LCD device uses the optical anisotropy and polarization properties of liquid crystal. Because the liquid crystal molecule has a round bar shape with a long axis and a short axis, the liquid crystal molecule has direction in its molecular arrangement. The molecular arrangement direction can be controlled by applying an electric field to a group of the liquid crystal molecules.

Accordingly, when the molecular arrangement direction of the liquid crystal molecules are arbitrarily controlled, lights supplied from a back-light installed on a rear surface of an LCD panel are selectively transmitted or intercepted according to the arrangement direction of the liquid crystal molecules. Images can be displayed on the LCD panel on the basis of the principle.

FIG. 1 is a cross-sectional diagram illustrating a conventional LCD device.

Referring to FIG. 1, the LCD device 10 includes a first substrate 20 and a second substrate 40 soldered to face each other with a predetermined cell-gap, a liquid crystal layer 30 formed at the cell-gap between the first substrate 20 and the second substrate 40, and a back-light 50 disposed on the rear surface of the second substrate 40 for supplying lights to an LCD panel 15 consisting of the first substrate 20, the second substrate 40 and the liquid crystal layer 30.

A black matrix 22 made of light intercepting material to divide light transmissible pixels is formed in a mesh shape along the outer edge of the pixels on a bottom surface of a transparent substrate 21 of the first substrate 20. R, G and B color filters 23 are disposed on the bottom surface of the transparent substrate 21 on which the black matrix 22 has been formed, so that lights transmitted from the pixels can have R, G and B color.

A transparent common electrode 24 which is a side electrode for applying an electric field to the liquid crystal layer 30 is formed at the lower portion of the color filter 23.

A thin film transistor (TFT) Ti for performing a switching operation and a transparent pixel electrode 42 for receiving a signal from the TFT T1 and applying an electric field to the liquid crystal layer 30 with the common electrode 24 are disposed at the upper portion of the transparent substrate 41 of the first substrate 40.

In addition, a plurality of gate lines arranged in the horizontal direction at regular intervals and a plurality of data lines arranged in the vertical direction at regular intervals are orthogonal at the upper portion of the transparent substrate 41 of the second substrate 40. Rectangular regions on which the gate lines and the data lines cross each other are defined as pixels. The pixel electrodes 42 are individually formed in the pixels.

The TFT T1 includes a gate electrode electrically connected to the gate lines, a source electrode electrically connected to the data lines, and a drain electrode electrically connected the pixel electrode 42.

However, the related art device has the following problems. First, a transmittance of lights transmitting through the color filter 23 is maximally 33%. That is, the light loss is large. In order to increase the brightness of the LCD device, lights generated by the back-light 50 must be made brighter, which results in higher power consumption.

Second, the color filter 23 is very expensive, increasing the manufacturing cost of the LCD device.

In order to solve the above problems, there has been suggested a time- sequential LCD device which can reproduce full color without the color filter 23.

Generally, when the related art LCD device is driven, the back-light is turned on to supply a white light. However, in the time-sequential LCD device, R, G and B back-lights are sequentially turned on at intervals of a predetermined time in one frame of an image, thereby displaying color images.

As compared with the conventional LCD device, the time-sequential LCD device does not require the color filter but uses the R, G and B back-lights to individually generate R, G and B lights.

The time-sequential LCD device divides one frame of the image into first to third sub-frames, sequentially supplies R, G and B image data of the first to third sub-frames to the LCD panel, and sequentially turns on the R, G and B back-light according to the first to third sub-frames, thereby displaying color images.

Accordingly, the time-sequential LCD device requires a frame memory for recording one frame of the image data and reading the recorded image data, and includes a first frame memory unit for recording odd-numbered frames of the image data and reading the odd-numbered frames of the recorded image data, and a second frame memory unit for recording even-numbered frames of the image data and reading the even-numbered frames of the recorded image data for a high speed driving.

That is, while the odd-numbered frames of the image data are being recorded in the first frame memory unit, the even-numbered frames of the image data are read from the second frame memory unit, and while the odd-numbered frames of the image data are being read from the first frame memory unit, the even-numbered frames of the image data are recorded in the second frame memory unit. As a result, the delay time in recording and reading the frames of the image data can be reduced thereby achieving high speed driving.

However, as described above, the time-sequential LCD device individually includes the first frame memory unit for recording the odd-numbered frames of the image data and reading the odd-numbered frames of the recorded image data, and the second frame memory unit for recording the even-numbered frames of the image data and reading the even-numbered frames of the recorded image data to achieve the high speed driving. Accordingly, the time-sequential LCD device requires a frame memory having a large recording capacity, which increases the cost of production.

SUMMARY OF THE INVENTION

Accordingly, the present invention is directed to a liquid crystal display device and method for driving the same that substantially obviates one or more of the problems due to limitations and disadvantages of the related art.

An advantage the present invention is to provide an LCD device and a method for driving the same which can minimize a recording capacity of a frame memory for recording and reading a frame of an image data so that the time-sequential LCD device can be driven at a high speed.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, there is provided an LCD device, including: a memory unit for recording image data of a first frame on a plurality of first blocks, and sequentially recording image data of a second frame on some of the first blocks and one or more second blocks; a control unit for time-sequentially dividing the first and second frames into a plurality of sub-frames, respectively, reading image data of each sub-frame from the image data of the first and second frames sequentially recorded on the first blocks and one or more second blocks of the memory unit, and sequentially applying the image data to an LCD panel; and a back-light for sequentially generating R, G and B lights according to the image data of the sub-frames.

In addition, there is provided a method for driving an LCD device, including the steps of: sequentially recording image data of a first frame on first blocks of a memory unit with a first frequency; starting reading of the image data of the first frame with a second frequency before finishing recording of the image data of the first frame; recording some of image data of a second frame on one or more second blocks of the memory unit with the first frequency, and sequentially recording the other image data of the second frame on the first blocks of the memory unit; and starting reading of the image data of the second frame with the second frequency before finishing recording of the image data of the second frame.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 6 is a detailed table showing recording and reading of each frame in first to $15^{th}$ blocks in FIG. 5.

DETAILED DESCRIPTION OF THE ILLUSTRATED EMBODIMENTS

Reference will now be made in detail to embodiments of the present invention, examples of which are illustrated in the accompanying drawings.

AN LCD device includes a memory unit for recording image data of a first frame on a plurality of first blocks, and sequentially recording image data of a second frame on some of the first blocks and one or more second blocks, a control unit for time-sequentially dividing the first and second frames into a plurality of sub-frames, respectively, reading image data of each sub-frame from the image data of the first and second frames sequentially recorded on the first blocks and one or more second blocks of the memory unit, and sequentially applying the image data to an LCD panel, and a back-light for sequentially generating R, G and B lights according to the image data of the sub-frames.

A method for driving an LCD device includes the steps of sequentially recording image data of a first frame on first blocks of a memory unit with a first frequency, starting reading of the image data of the first frame with a second frequency before finishing recording of the image data of the first frame, recording some of image data of a second frame on one or more second blocks of the memory unit with the first frequency and sequentially recording the other image data of the second frame on the first blocks of the memory unit, and starting reading of the image data of the second frame with the second frequency before finishing recording of the image data of the second frame.

Figure 1:
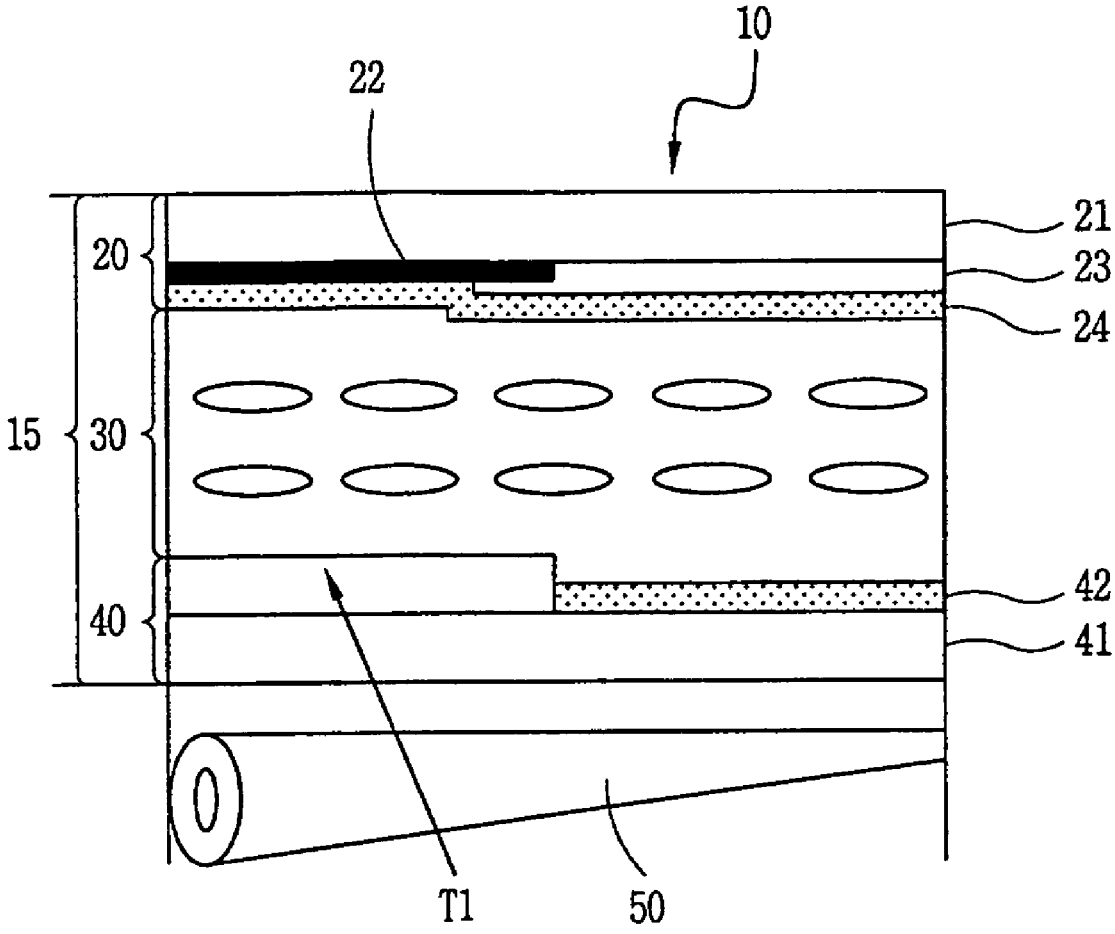
FIG. 1 RELATED ART
FIG. 1 is a cross-sectional diagram illustrating a conventional LCD device.
Figure 2:
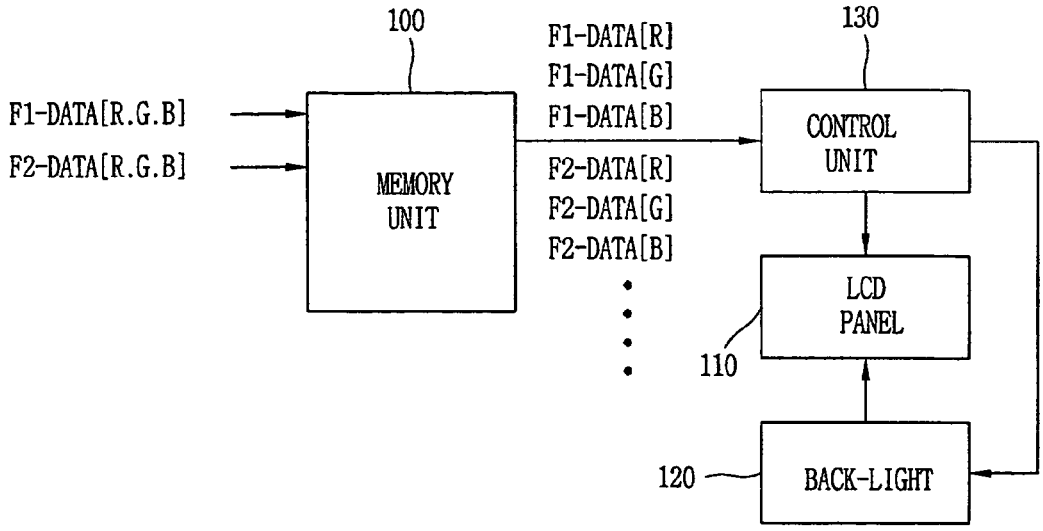
FIG. 2 is a block diagram illustrating an LCD device in accordance with the present invention.

FIG. 2 is a block diagram illustrating the LCD device according to the present invention.

As illustrated in FIG. 2, the LCD device includes a memory unit 100 for recording image data of a first frame F1-DATA [R,G,B] on a plurality of first blocks (not shown), and sequentially recording image data of a second frame F2-DATA[R, G,B] on one or more second blocks (not shown) and some of the first blocks, a control unit 130 for time-sequentially dividing the first and second frames into first to third sub-frames, respectively, reading image data F1-DATA[R], F1-DATA[G], F1-DATA[B], F2-DATA[R], F2-DATA[G] and F2-DATA[B] of the first to third sub-frames from the data of the first and second frames F1-DATA[R,G,B] and F2-DATA[R,G,B] sequentially recorded on the first blocks and one or more second blocks of the memory unit 100, and sequentially supplying the image data F1-DATA[R], F1-DATA[G], F1-DATA [B], F2-DATA[R], F2-DATA[G] and F2-DATA[B] to an LCD panel 110, and R, G and B back-lights 120 for sequentially generating R, G and B lights according to the first to third sub-frames.

The memory unit 100 records the image data of the first frame F1-DATA[R,G,B] in the plurality of first blocks, records some of the image data of the second frame F2-DATA [R,G,B] in one or more second blocks, and sequentially records the rest of image data of the second frame in some of the first blocks.

After the image data of the second frame F2-DATA[R,G,B] is recorded in some of the first blocks of the memory unit 100, the image data of third to last frames is sequentially recorded in the first blocks and one or more second blocks of the memory unit 100 in the same manner.

The control unit 130 time-sequentially divides the first and second frames into the first to third sub-frames, respectively, reads the image data F1-DATA[R], F1-DATA[G], F1-DATA[B], F2-DATA[R], F2-DATA[G] and F2-DATA[B] corresponding to the first to third sub-frames from the image data of the first and second frames F1-DATA[R,G,B] and F2-DATA[R,G,B] sequentially recorded in the first blocks and one or more second blocks of the memory unit 100, and sequentially supplies the image data F1-DATA[R], F1-DATA[G], F1-DATA[B], F2-DATA[R], F2-DATA[G] and F2-DATA[B] to the LCD panel 110.

The control unit 130 reads the image data F2-DATA[B] corresponding to the third sub-frame of the second frame from the memory unit 100 and applies the image data F2-DATA[B] to the LCD panel 110. In the same manner as that of the first and second frames, the control unit 130 time-sequentially divides the third to last frames into first to third sub-frames, respectively, reads image data corresponding to the first to third sub-frames from image data of the third to last frames sequentially recorded on the first blocks and one or more second blocks of the memory unit 100, and sequentially applies the information to the LCD panel 110, thereby time-sequentially driving the LCD panel 110.

The LCD panel 110 is time-sequentially driven by sequentially receiving the image data F1-DATA[R], F1-DATA[G], F1-DATA[B], F2-DATA[R], F2-DATA[G] and F2-DATA[B] corresponding to the first to third sub-frames from the control unit 130. That is, the LCD panel 110 displays color images according to the image data F1-DATA[R], F1-DATA[G], F1-DATA[B], F2-DATA[R], F2-DATA[G] and F2-DATA[B] of the first to third sub-frames by the R, G and B lights sequentially supplied from the back-lights 120.

The LCD panel 110 includes first and second substrates soldered to face each other with a predetermined cell-gap, and a liquid crystal layer formed at the cell-gap between the first and second substrates.

Ferroelectric liquid crystals, optical compensated birefringent (OCB) liquid crystals or twisted nematic (TN) liquid crystals characterized by high speed responses may be used as the liquid crystal layer.

A black matrix made of light blocking material is formed in a mesh shape along peripheral regions of pixels on the first substrate. A common electrode is formed as one side electrode for applying an electric field to the liquid crystal layer.

A plurality of pixels are arranged in a matrix shape on the second substrate. A pixel electrode for applying an electric field to the liquid crystal layer with the common electrode is individually disposed in the pixels.

If the common electrode is formed on the first substrate and the pixel electrode is formed on the second substrate, liquid crystal molecules of the liquid crystal layer are rearranged by a vertical electric field generated between the common electrode and the pixel electrode.

On the other hand, the common electrode and the pixel electrode may be formed on the second substrate. In this case, the liquid crystal molecules of the liquid crystal layer are driven by a horizontal electric field generated between the common electrode and the pixel electrode. The method of forming the pixel electrode and the common electrode on the second substrate and driving the liquid crystal molecules of the liquid crystal layer by the horizontal field is called In Plane Switching (IPS).

A plurality of gate lines arranged in the horizontal direction at predetermined intervals and a plurality of data lines arranged in the vertical direction at predetermined intervals cross each other at the upper portion of the second substrate. The pixels are defined in rectangular regions on which the gate lines and the data lines cross each other, and arranged in a matrix shape. The pixel electrodes are individually formed in the pixels.

A TFT includes a gate electrode electrically contacting the gate lines, a source electrode electrically contacting the data lines, and a drain electrode electrically contacting the pixel electrode 42.

As compared with the related art device, the time-sequential LCD device does not require the color filter but use the back-lights 120 to individually turn on R, G and B light sources.

When the time-sequential LCD device is driven at 60 Hz, the R, G and B lights are flashed by an inverter (not shown) 60 times per second, totally 180 times, and mixed to display colors by a visual afterimage effect. That is, although the R, G and B colors are flashed 60 times per second, the user recognizes as if the R, G and B lights were continuously emitted. For example, after the R light is flashed, if the B light is flashed within a short time, the user sees violet color due to the visual afterimage effect.

The time-sequential LCD device overcomes the problems of reduced brightness occurring in the related art device using the color filter, and reproduces full color using the R, G and B back-light, thereby providing any LCD panel having excellent brightness and contrast properties and reducing the cost of production. As a result, an LCD device having a large area may be efficiently manufactured.

The back-lights 120 includes a light guide plate disposed to correspond to substantially the entire rear surface of the LCD panel 110, and a light source unit disposed on one side or both side surfaces of the light guide plate, for generating R, G and B lights. The back-lights 120 in which the light source unit for generating the R, G and B lights is disposed on one side or both side surfaces of the light guide plate is called a wave guide type back-light.

Diagonal back-lights in which a light source unit for generating R, G and B lights is disposed to correspond to substantially the entire rear surface of the LCD panel 110 and a scatter plate is disposed between the light source unit and the LCD panel 110 for directly supplying the R, G and B lights to the whole surface of the LCD panel 110 can be used as the back-lights 120. The diagonal back-lights 120 is mostly applied to the LCD device requiring high brightness.

Figure 3:
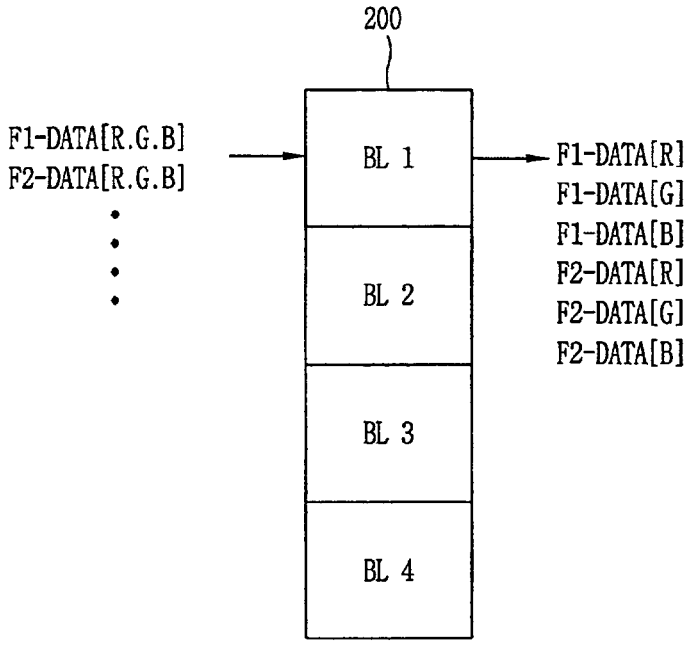
FIG. 3 is an exemplary diagram illustrating a first example of a memory unit in FIG. 2.

FIG. 3 is a diagram illustrating a first example of the memory unit 100 in FIG. 2.

As shown in FIG. 3, the memory unit 200 records the image data F1-DATA[R,G,B] of the first frame on first to third blocks BL1 to BL3, records some of the image data F2-DATA[R,G,B] of the second frame on a fourth block BL4, and sequentially records the other image data of the second frame on the first and second blocks BL1 and BL2.

In addition, the memory unit 200 sequentially outputs the image data F1-DATA[R], F1-DATA[G], F1-DATA[B], F2-DATA[R], F2-DATA[G] and F2-DATA[B] corresponding to the first to third sub-frames from the image data F1-DATA[R,G,B] and F2-DATA[R,G,B] of the first and second frames sequentially recorded on the first to fourth blocks BL1 to BL4 to the control unit 130 of FIG. 2 according to the control signal from the control unit 130.

Figures 4, 5:
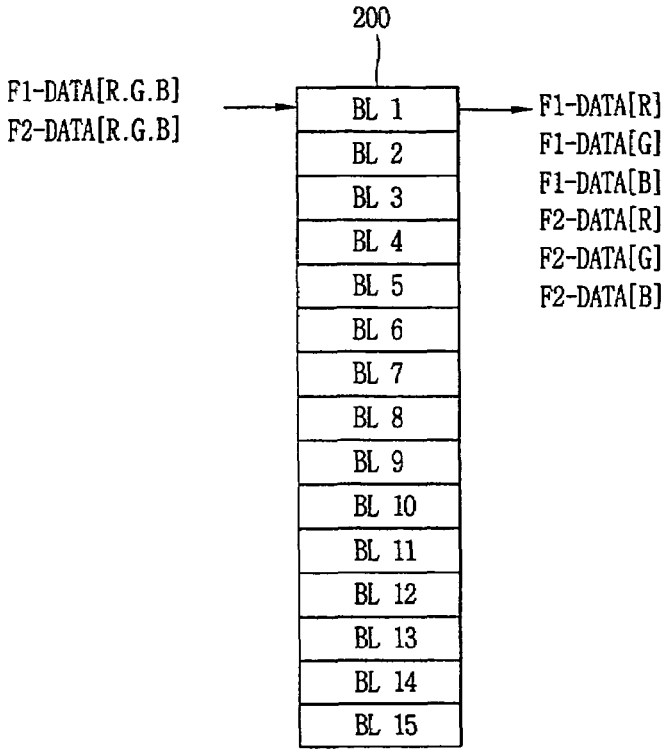
FIG. 4 is a detailed table showing recording and reading of each frame in first to fourth blocks in FIG. 3.
FIG. 5 is an exemplary diagram illustrating a second example of the memory unit in FIG. 2.

FIG. 4 is a detailed table showing recording and reading of each frame in the first to fourth blocks BL1 to BL4 in FIG. 3. The driving operation of the memory unit 200 will now be explained in detail with reference to FIGS. 3 and 4.

The image data F1-DATA[R,G,B] of the first frame is sequentially recorded on the first to third blocks BL1 to BL3 of the memory unit 200 with the first frequency. When the image data F1-DATA[R,G,B] of the first frame is recorded on the third block BL3, the image data F1-DATA[R,G,B] of the first frame starts to be read a first time with the second frequency.

In the memory unit 200, the second frequency for reading the image data F1-DATA[R,G,B] of the first frame is three times as fast as the first frequency for recording the image data F1-DATA[R,G,B] of the first frame.

As described above, as reading of the image data F1-DATA [R,G,B] of the first frame is performed three times faster than the recording thereof, when the recording of the image data F1-DATA[R,G,B] of the first frame on the third block BL3 of the memory unit 200 is finished, the first reading of the image data F1-DATA[R,G,B] of the first frame from the first to third blocks BL1 to BL3 of the memory unit 200 is finished as well. In the first reading, the image data F1-DATA[R] corresponding to the first sub-frame of the first frame is read from the image data F1-DATA[R,G,B] of the first frame recorded on the first to third blocks BL1 to BL3 of the memory unit 200, and applied to the LCD panel 110 through the control unit 130 of FIG. 2.

The image data F2-DATA[R,G,B] of the second frame is sequentially recorded on the fourth to second blocks BL4 to BL2 of the memory unit 200 with the first frequency. When the image data F2-DATA[R,G,B] of the second frame is recorded on the fourth block BL4, the image data F1-DATA [R,G,B] of the first frame starts to be read a second time with the second frequency.

As described above, as the second frequency for reading the image data F1-DATA[R,G,B] of the first frame is three times as fast as the first frequency for recording the image data F2-DATA[R,G,B] of the second frame, when the recording of some of the image data F2-DATA[R,G,B] of the second frame on the fourth block BL4 of the memory unit 200 is finished, the second reading of the image data F1-DATA[R,G,B] of the first frame from the first to third blocks BL1 to BL3 of the memory unit 200 is finished. In the second reading, the image data F1-DATA[G] corresponding to the second sub-frame of the first frame is read from the image data F1-DATA[R,G,B] of the first frame recorded on the first to third blocks BL1 to BL3 of the memory unit 200, and applied to the LCD panel 110 through the control unit 130 of FIG. 2.

In addition, when the image data F2-DATA[R,G,B] of the second frame is recorded on the first block BL1 with the first frequency, the image data F1-DATA[R,G,B] of the first frame starts to be read a third time with the second frequency.

As described above, as the second frequency for reading the image data F1-DATA[R,G,B] of the first frame is three times higher than the first frequency for recording the image data F2-DATA[R,G,B] of the second frame, when, the recording of some of the image data F2-DATA[R,G,B] of the second frame on the first block BL1 of the memory unit 200 is finished, the third reading of the image data F1-DATA[R,G, B] of the first frame from the first to third blocks BL1 to BL3 of the memory unit 200 is finished. In the third reading, the image data F1-DATA[B] corresponding to the third sub-frame of the first frame is read from the image data F1-DATA [R,G,B] of the first frame recorded on the first to third blocks BL1 to BL3 of the memory unit 200, and applied to the LCD panel 110 through the control unit 130 of FIG. 2.

On the other hand, referring to FIG. 4, errors may occur in data recording and reading because recording of the image data F2-DATA[R,G,B] of the second frame and third reading of the image data F1-DATA[R,G,B] of the first frame are simultaneously performed in the first block BL1 of the memory unit 200. However, as described above, as the second frequency for reading the image data F1-DATA[R,G,B] of the first frame is three times faster than the first frequency for recording the image data F2-DATA[R,G,B] of the second frame, the image data F2-DATA[R,G,B] of the second frame is recorded after the image data F1-DATA[R,G,B] of the first frame is read a third time. Therefore, errors do not occur in data recording and reading.

When the image data F2-DATA[R,G,B] of the second frame is recorded on the second block BL2 with the first frequency, the image data F2-DATA[R,G,B] of the second frame starts to be read a first time with the second frequency.

As described above, as the second frequency for reading the image data F2-DATA[R,G,B] of the second frame is three times faster than the first frequency for recording the image data F2-DATA[R,G,B] of the second frame, when the recording of the image data F2-DATA[R,G,B] of the second frame on the second block BL2 of the memory unit 200 is finished, the first reading of the image data F2-DATA[R,G,B] of the second frame from the fourth to second blocks BL4 to BL2 of the memory unit 200 is finished. In the first reading, the image data F2-DATA[R] corresponding to the first sub-frame of the second frame is read from the image data F2-DATA[R,G,B] of the second frame recorded on the fourth to second blocks BL4 to BL2 of the memory unit 200, and applied to the LCD panel 110 through the control unit 130 of FIG. 2.

Here, the process for reading the image data F2-DATA[G] and F2-DATA[B] of the second and third sub-frames of the second frame and applying the image data F2-DATA[G] and F2-DATA[B] to the LCD panel 110 through the control unit 130 of FIG. 2, and the process for sequentially recording the image data of the third to last frames on the first to fourth blocks BL1 to BL4 of the memory unit 200, reading the image data of the first to third sub-frames of the third to last frames, and applying the image data to the LCD panel 110 through the control unit 130 of FIG. 2 are repeatedly performed in the same manner as that of the first and second frames, and thus detailed explanations thereof are omitted.

FIG. 5 is an exemplary diagram illustrating a second example of the memory unit 100 in FIG. 2.

As depicted in FIG. 5, the memory unit 300 records the image data F1-DATA[R,G,B] of the first frame on first to ninth blocks BL1 to BL9, records some of the image data F2-DATA[R,G,B] of the second frame on $10^{th}$ to 15th blocks BL10 to BL15, and sequentially records the other image data of the second frame on the first to third blocks BL1 to BL3.

In addition, the memory unit 300 sequentially applies the image data F1-DATA[R], F1-DATA[G], F1-DATA[B], F2-DATA[R], F2-DATA[G] and F2-DATA[B] of the first to third sub-frames from the image data F1-DATA[R,G,B] and F2-DATA[R,G,B] of the first and second frames sequentially recorded on the first to $15^{th}$ blocks BL1 to BL15 to the LCD panel 110 through the control unit 130 of FIG. 2 according to the control signal from the control unit 130.

FIG. 6 is a detailed table showing recording and reading of each frame in the first to $15^{th}$ blocks BL1 to BL15 in FIG. 5. The driving operation of the memory unit 300 will now be explained in detail with reference to FIGS. 5 and 6.

The image data F1-DATA[R,G,B] of the first frame is sequentially recorded on the first to ninth blocks BL1 to BL9 of the memory unit 300 with the first frequency, and the image data F2-DATA[R,G,B] of the second frame is sequentially recorded on the $10^{th}$ to $15^{th}$ blocks BL10 to BL15 and the first to third blocks BL1 to BL3 of the memory unit 300 with the first frequency. When the image data F2-DATA[R,G,B] of the second frame is recorded on the $10^{th}$ block BL10, the image data F1-DATA[R,G,B] of the first frame starts to be read a first time with the second frequency.

In the memory unit 300, the second frequency for reading the image data F1-DATA[R,G,B] of the first frame is nine times as fast as the first frequency for recording the image data F1-DATA[R,G,B] of the first frame.

As described above, because the reading of the image data F1-DATA[R,G,B] of the first frame is performed nine times faster than the recording thereof, when the recording of some of the image data F2-DATA[R,G,B] of the second frame on the $10^{th}$ block BL10 of the memory unit 300 is finished, first reading of the image data F1-DATA[R,G,B] of the first frame from the first to ninth blocks BL1 to BL9 of the memory unit 300 is finished. In the first reading, the image data F1-DATA [R] corresponding to the first sub-frame of the first frame is read from the image data F1-DATA[R,G,B] of the first frame recorded on the first to ninth blocks BL1 to BL9 of the memory unit 300, and applied to the LCD panel 110 through the control unit 130 of FIG. 2.

On the other hand, while some of the image data F2-DATA [R,G,B] of the second frame is recorded on the $11^{th}$ and $12^{th}$ blocks BL11 and BL12 of the memory unit 300, the image data F1-DATA[R,G,B] of the first frame is not read to obtain a delay time by driving of the time-sequential LCD device after reading the image data F1-DATA[R,G,B] of the first frame.

That is, the time-sequential LCD device time-sequentially divides one frame of the image into the first to third sub-frames, and sequentially applies the image data of the first to third sub-frames, to time-sequentially drive the LCD panel.

Figure 7:
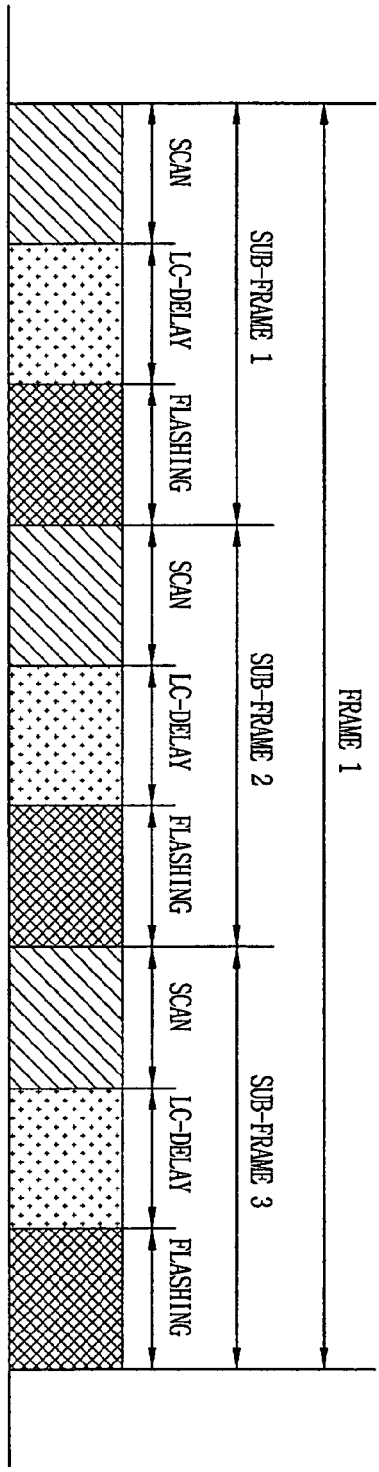
FIG. 7 is a time chart based on a method for driving a time-sequential LCD device.

FIG. 7 is a time chart based on a method for driving a time-sequential LCD device.

As illustrated in FIG. 7, in a first sub-frame SUB-FRAME1 of a first frame FRAME1, scan signals are sequentially applied to gate lines during a scan period SCAN, and image data on R color is supplied to an LCD panel through data lines.

Liquid crystal molecules of the LCD panel receiving the image data on the R color during the scan period SCAN respond to the image data on the R color during a liquid crystal delay period LC-DELAY, and thus arrangement thereof is changed. Because the liquid crystals have inherent properties such as viscosity and springback, the liquid crystals slowly respond to an external electric field. Therefore, in order to change the arrangement state of the liquid crystal molecules according to the image data, the liquid crystal delay period LC-DELAY must be sufficiently long.

When the arrangement state of the liquid crystal molecules is changed during the liquid crystal delay period LC-DELAY, an R back-light is turned on during a flashing period. Accordingly, an R image is displayed on the LCD panel, and the first sub-frame SUB-FRAME1 is ended.

A second sub-frame SUB-FRAME2 of the first frame FRAME1 is executed after the first sub-frame SUB-FRAME1 is ended.

In the second sub-frame SUB-FRAME2, image data of G color is supplied during a scan period SCAN, the arrangement state of the liquid crystal molecules is changed according to the image data of the G color during a liquid crystal delay period LC-DELAY, and a G back-light is turned on during a flashing period FLASHING. Therefore, a G image is displayed on the LCD panel.

A third sub-frame SUB-FRAME3 of the first frame FRAME1 is executed after the second sub-frame SUB-FRAME2 is ended.

Identically to the first sub-frame SUB-FRAME1 and the second sub-frame SUB-FRAME2, in the third sub-frame SUB-FRAME3, image data of the B color is supplied during a scan period SCAN, the arrangement state of the liquid crystal molecules is changed according to the image data of the B color during a liquid crystal delay period LC-DELAY, and a B back-light is turned on during a flashing period FLASHING. Thus, a B image is displayed on the LCD panel.

As mentioned above, the R color image data is supplied during the scan period SCAN in the first sub-frame SUB-FRAME1, and the LCD panel displays the R color during the flashing period FLASHING after the liquid crystal delay period LC-DELAY. Accordingly, the G color image data of the second sub-frame SUB-FRAME2 is delayed during the liquid crystal delay period LC-DELAY and the flashing period FLASHING of the first sub-frame SUB-FRAME1. In the same manner, the B color image data of the third sub-frame SUB-FRAME3 is delayed during the liquid crystal delay period LC-DELAY and the flashing period FLASHING of the second sub-frame SUB-FRAME2.

Therefore, in order to read the image data F1-DATA[R,G, B] of the first frame recorded on the first to ninth blocks BL1 to BL9 of the memory unit 300 a first time, apply the image data FA-DATA[R] of the first sub-frame of the first frame to the LCD panel during the scan period SCAN and display the image data F1-DATA[R] during the liquid crystal delay period LC-DELAY and the flashing period FLASHING, while some of the image data F2-DATA[R,G,B] of the second frame is recorded on the $11^{th}$ and $12^{th}$ blocks BL11 and BL12 of the memory unit 300, the image data F1-DATA[R,G,B] of the first frame recorded on the first to ninth blocks BL1 to BL9 of the memory unit 300 is not read.

When some of the image data F2-DATA[R,G,B] of the second frame is recorded on the $13^{th}$ block BL13, the image data F1-DATA[R,G,B] of the first frame recorded on the first to ninth blocks BL1 to BL9 of the memory unit 300 starts to be read a second time.

As described above, as the second frequency for reading the image data F1-DATA[R,G,B] of the first frame is nine times faster than the first frequency for recording the image data F2-DATA[R,G,B] of the second frame, when the recording of some of the image data F2-DATA[R,G,B] of the second frame on the $13^{th}$ block BL13 of the memory unit 300 is finished, the second reading of the image data F1-DATA[R, G,B] of the first frame from the first to ninth blocks BL1 to BL9 of the memory unit 300 is finished. In the second reading, the image data F1-DATA[G] corresponding to the second sub-frame of the first frame is read from the image data F1-DATA[R,G,B] of the first frame recorded on the first to ninth blocks BL1 to BL9 of the memory unit 300, and applied to the LCD panel 110 through the control unit 130 of FIG. 2.

In the same manner, in order to read the image data F1-DATA[R,G,B] of the first frame recorded on the first to ninth blocks BL1 to BL9 of the memory unit 300 a second time, apply the image data F1-DATA[G] of the second sub-frame of the first frame to the LCD panel during the scan period SCAN and display the image data F1-DATA[G] during the liquid crystal delay period LC-DELAY and the flashing period FLASHING, while some of the image data F2-DATA[R,G,B] of the second frame is recorded on the $14^{th}$ and $15^{th}$ blocks BL14 and BL15 of the memory unit 300, the image data F1-DATA[R,G,B] of the first frame recorded on the first to ninth blocks BL1 to BL9 of the memory unit 300 is not read.

When some of the image data F2-DATA[R,G,B] of the second frame is recorded on the first block BL1, the image data F1-DATA[R,G,B] of the first frame recorded on the first to ninth blocks BL1 to BL9 of the memory unit 300 starts to be read a third time.

As described above, as the second frequency for reading the image data F1-DATA[R,G,B] of the first frame is nine times faster than the first frequency for recording the image data F2-DATA[R,G,B] of the second frame, when the recording of some of the image data F2-DATA[R,G,B] of the second frame on the first block BL1 of the memory unit 300 is finished, the third reading of the image data F1-DATA[R,G,B] of the first frame from the first to ninth blocks BL1 to BL9 of the memory unit 300 is finished. In the third reading, the image data F1-DATA[B] corresponding to the third sub-frame of the first frame is read from the image data F1-DATA[R,G,B] of the first frame recorded on the first to ninth blocks BL1 to BL9 of the memory unit 300, and applied to the LCD panel 110 through the control unit 130 of FIG. 2.

In addition, in order to read the image data F1-DATA[R,G,B] of the first frame recorded on the first to ninth blocks BL1 to BL9 of the memory unit 300 a third time, apply the image data F1-DATA[B] of the third sub-frame of the first frame to the LCD panel during the scan period SCAN and display the image data F1-DATA[B] during the liquid crystal delay period LC-DELAY and the flashing period FLASHING, while some of the image data F2-DATA[R,G,B] of the second frame is recorded on the second and third blocks BL2 and BL3 of the memory unit 300, the image data F1-DATA[R,G,B] of the first frame recorded on the first to ninth blocks BL1 to BL9 of the memory unit 300 is not read.

On the other hand, referring to FIG. 6, it looks like errors may occur in data recording and reading because recording of the image data F2-DATA[R,G,B] of the second frame and third reading of the image data F1-DATA[R,G,B] of the first frame are simultaneously performed in the first block BL1 of the memory unit 300. However, as described above, as the second frequency for reading the image data F1-DATA[R,G,B] of the first frame is nine times faster than the first frequency for recording the image data F2-DATA[R,G,B] of the second frame, the image data F2-DATA[R,G,B] of the second frame is recorded after the image data F1-DATA[R,G,B] of the first frame is read a third time. Therefore, errors do not occur in data recording and reading.

When the image data of the third frame is recorded on the fourth block BL4 of the memory unit 300 with the first frequency, the image data F2-DATA[R,G,B] of the second frame recorded on the $10^{th}$ to third blocks BL10 to BL3 of the memory unit 300 starts to be read a first time with the second frequency.

As described above, as the second frequency for reading the image data F2-DATA[R,G,B] of the second frame is three times faster than the first frequency for recording the image data of the third frame, when the recording of the image data of the third frame on the fourth block BL4 of the memory unit 300 is finished, the first reading of the image data F2-DATA[R,G,B] of the second frame from the $10^{th}$ to third blocks BL10 to BL3 of the memory unit 300 is finished. In the first reading, the image data F2-DATA[R] of the first sub-frame of the second frame is read from the image data F2-DATA[R,G,B] of the second frame recorded on the $10^{th}$ to third blocks BL10 to BL3 of the memory unit 300, and applied to the LCD panel 110 through the control unit 130 of FIG. 2.

Here, the process for recording the image data of the third to last frames on the first to $15^{th}$ blocks BL1 to BL15 of the memory unit 300 and reading the image data F2-DATA[G] and F2-DATA[B] of the second and third sub-frames of the second frame, and the process for reading the image data of the first to third sub-frames of the third to last frames are repeatedly performed in the same manner as that of the first and second frames, and thus detailed explanations thereof are omitted.

In accordance with the present invention, the LCD device and the method for driving the same record one frame of the image on the first blocks of the memory unit consisting of the plurality of first blocks and one or more second blocks with the first frequency, record the succeeding frame of the image on one or more second blocks and some of the first blocks with the first frequency, and read the frames of the image sequentially recorded on the first blocks and one or more second blocks with the second frequency in a multiple number, so that the LCD device can be time-sequentially driven. As a result, the recording capacity of the memory unit for driving the time-sequential LCD device at a high speed can be minimized.

When the first example of the memory unit is applied, the recording capacity can be reduced by more than that of the method using the first and second frame memories for individually recording and reading the even-numbered frames and the odd-numbered frames by 33.3%, and when the second example of the memory unit is applied, the recording capacity can be reduced by more than that of the method using the first and second frame memories for individually recording and reading the even-numbered frames and the odd-numbered frames by 16.6%.

As discussed earlier, in accordance with the present invention, the LCD device and the method for driving the same record the image data of one frame on the plurality of first blocks and one or more second blocks of the memory unit with the first frequency, record the image data of the succeeding frame on one or more second blocks and some of the first blocks with the first frequency, and read the image data of the frames sequentially recorded on the first blocks and one or more second blocks with the second frequency in a multiple number, so that the LCD device can be time-sequentially driven.

Accordingly, the recording capacity of the memory unit can be reduced more than that of the method using the first and second frame memories for individually recording and reading the even-numbered frames and the odd-numbered frames to drive the LCD device at a high speed, thereby minimizing the space occupied by the memory unit in the driving unit of the time-sequential LCD device.

In addition, as the required recording capacity of the memory unit is reduced, the frame memory having the small recording capacity may be used, to cut down the prime cost of production of the time-sequential LCD device.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An LCD device, comprising:

a memory unit for recording image data of a first frame in a plurality of first blocks, and sequentially recording image data of a second frame in one or more second blocks and at least one of the first blocks with a first frequency;

a control unit for time-sequentially dividing the first and second frames into a plurality of sub-frames, respectively, reading image data of the sub-frames from the image data of the first and second frames sequentially with a second frequency recorded in the first blocks and at least one of the second blocks of the memory unit, and sequentially supplying the image data to an LCD panel; and a plurality of back-lights for sequentially generating R, G and B lights according to the image data of the sub-frames, wherein image data of the first frame starts to be read by the control unit when image data of a last sub-frame of the first frame is recorded in the memory unit, and image data of the second frame starts to be read by the control unit when image data of a last sub-frame of the second frame is recorded in the memory unit.

2. The device of claim 1, wherein the first frame is an odd-numbered frame, and the second frame is an even-numbered frame.

3. The device of claim 1, wherein the number of the first blocks of the memory unit is three.

4. The device of claim 1, wherein the number of one or more second blocks of the memory unit is one.

5. A method for driving an LCD device, comprising:

sequentially recording image data of a first frame in first blocks of a memory unit with a first frequency;

beginning the reading of image data of the first frame with a second frequency when the image data of the first frame is recorded in a last block of first blocks of the memory unit;

recording some image data of a second frame in one or more second blocks of the memory unit with the first frequency, and sequentially recording the other image data of the second frame in the first blocks of the memory unit; and beginning the reading of the image data of the second frame with the second frequency before finishing recording of the image data of the second frame.

6. The method of claim 5, wherein the number of the first blocks of the memory unit is three, and the number of one or more second blocks is one.

7. The method of claim 5, wherein the second frequency is set three times as fast as the first frequency.

8. The method of claim 5, wherein the image data of the first and second frames is read three times, respectively.

9. A method for driving an LCD device, comprising the steps of:

sequentially recording image data of a first frame in first blocks of a memory unit with a first frequency;

recording some image data of a second frame in second blocks of the memory unit with the first frequency, recording the other image data of the second frame on some of the first blocks with the first frequency, and reading image data of the first-frame recorded in the first blocks with a second frequency; and recording some image data of a third frame on the other first blocks with the first frequency, recording the other image data of the third frame on some of the second blocks with the first frequency, and reading the image data of the second frame recorded on the second blocks and some of the first blocks with the second frequency, wherein image data of the first frame starts to be read when image data of the second frame starts to be recorded in the memory unit, and image data of the second frame starts to be read when image data of the third frame starts to be recorded in the memory unit.

10. The method of claim 9, wherein the number of the first blocks of the memory unit is nine, and the number of the second blocks is six.

11. The method of claim 9, wherein the second frequency is set nine times as fast as the first frequency.

12. The method of claim 9, wherein the image data of the first and second frames is read three times, respectively.

13. The method of claim 9, wherein the image data of the first frame is read three times, and a delay time exists between the reading operations.

14. The method of claim 13, wherein the delay time corresponds to a response time of liquid crystal molecules of an LCD panel to the read image data of the first or second frame and an emission time of back-lights supplying lights to the LCD panel.

15. The method of claim 9, wherein the image data of the second frame is read three times, and a delay time exists between the reading operations.

16. The method of claim 15, wherein the delay time corresponds to a response time of liquid crystal molecules of an LCD panel to the read image data of the first or second frame and an emission time of back-lights supplying lights to the LCD panel.

17. AN LCD device, comprising:

a memory unit for recording image data of a first frame in a plurality of first blocks, and sequentially recording image data of a second frame in one or more second blocks and at least one of the first blocks with a first frequency;

a control unit for time-sequentially dividing the first and second frames into a plurality of sub-frames, respectively, reading image data of the sub-frames from the image data of the first and second frames sequentially with a second frequency recorded in the first blocks and at least one of the second blocks of the memory unit, and sequentially supplying the image data to an LCD panel; and a plurality of back-lights for sequentially generating R, G and B lights according to the image data of the sub-frames, wherein image data of the first frame starts to be read by the control unit when image data of the first sub-frame of the second frame is recorded in memory, and image data of the second frame starts to be read by the control unit when image data of the first sub-frame of the third frame is recorded in memory.

18. The device of claim 17, wherein the first frame is an odd-numbered frame, and the second frame is an even-numbered frame.

19. The device of claim 17, wherein the number of the first blocks of the memory unit is nine.

20. The device of claim 17, wherein the number of one or more second blocks of the memory unit is six.

* * * * *